United States Patent [19]

Samuels et al.

[11] 4,003,334

[45] Jan. 18, 1977

[54] DEVELOPER ROLLER FOR ELECTROSTATIC COPIER

[75] Inventors: Abe Samuels, Chicago; Roger Wiggerman, McHenry, both of Ill.

[73] Assignee: Speed-O-Print Business Machines Corporation, Chicago, Ill.

[22] Filed: Dec. 22, 1975

[21] Appl. No.: 643,012

Related U.S. Application Data

[63] Continuation-in-part of Ser. No. 630,790, Nov. 11, 1975.

[52] U.S. Cl. ..... 118/658; 427/18

[51] Int. Cl.[2] ..... G03G 15/09

[58] Field of Search ..... 118/637, 623; 355/3 DD; 427/428, 18

[56] References Cited

UNITED STATES PATENTS

| | | | |
|---|---|---|---|
| 3,152,924 | 10/1964 | Wanielista et al. | 118/637 |
| 3,176,652 | 4/1965 | Mott et al. | 118/637 |
| 3,839,992 | 10/1974 | Takahashi et al. | 118/637 |
| 3,863,603 | 2/1974 | Buckley et al. | 118/637 |
| 3,879,737 | 4/1975 | Lunde | 355/3 DD |
| 3,909,258 | 9/1975 | Kotz | 118/637 |

*Primary Examiner*—Henry S. Jaudon

*Attorney, Agent, or Firm*—Johnson, Dienner, Emrich & Wagner

[57] ABSTRACT

An electrostatic photocopy machine of the type which uses a magnetic dry toner is disclosed, wherein the toner particles are magnetically attracted to the surface of a developer roller, and thereafter deposited onto the charged image areas on one surface of a copy sheet. The developer roller is provided with an outer shell which is electrically non-conductive, thereby producing improved results in the copy.

10 Claims, 6 Drawing Figures

1
2
3
4
4a
5
6
7
8
9
10
11
12
13
14
15
16
N
S

DEVELOPER ROLLER FOR ELECTROSTATIC COPIER

BACKGROUND OF THE INVENTION

This is a continuation-in-part of our application Ser. No. 630,790, filed Nov. 11, 1975.

Heretofore in the prior art there have been a number of methods used for developing a latent electrostatic image on a surface wherein a magnetic dry toner material is used. Until recently the commonly used toner is one which consists of a toner powder and a carrier material. Such carrier material consists of magnetically attractable powders such as magnetic ferrites. More recently a toner powder has been developed which is known as a "single component" material, and in such toner there is no separate carrier material.

One method which has been used in the past for applying the electroscopic developer powder to an electrostatic image bearing member has involved the use of a developer roller in association with which a magnetic field is established whereby the toner and carrier particles are attracted to the outer surface of the roller and then deposited onto the electrostatic image bearing surface, after which the carrier material drops by gravity into the supply trough. Such an apparatus and method are disclosed, for example, in the Patent to Hall U.S. Pat. No. 3,015,305.

More recently Kotz U.S. Pat. No. 3,909,258 issued which discloses a method of applying a single component toner material to the charged image areas of a copy sheet. In this latter patent, however, it was stressed that the outer shell of the developer roller had to be electrically conductive. It has been determined that such electrically conductive outer shell has certain disadvantages from the standpoint that, when the outer shell is made of aluminum, for example, which is electrically conductive, certain chemicals used in the toner may attack the virgin raw aluminum resulting in imperfection of the development roller surface. Such imperfections cause poor reproduction of copies.

This disadvantage has been overcome in the present invention by the use of an outer shell, at least the outer surface of which is electrically non-conductive. The Hall Patent discloses the use of an outer shell which is electrically insulating, but the structure therein has the magnets outside of the shell, and is adapted for use with a toner which has as a part thereof a carrier material. Thus the use of a non-conductive outer shell with a single component toner material provides greatly improved results and has advantages over both the aforementioned Hall and Kotz patents.

BRIEF SUMMARY OF THE INVENTION

The invention herein relates generally to an improved developer roller for use in an electrostatic copy machine, for applying single component toner to the charged image areas of the surface.

More specifically the invention relates to the provision, in a developer roller of such a machine, of an outer shell wherein the outer surface thereof to which the toner particles are attracted by a magnetic field, is electrically nonconductive, whereby such surface will not be attacked chemically, thereby eliminating imperfections in such surface and improving reproduction of copies.

It is a specific object of the invention to provide an improved outer shell of a developer roller wherein, the shell is electrically non-conductive.

Another object of the invention is to provide an outer shell for such a developer roller which may be made of a metal such as aluminum, and wherein at least the outer surface thereof is "hardcoat" anodized.

Still another object of the invention is to provide an outer shell for the developer roller in an electrostatic copy machine utilizing a single component toner material, wherein all of the external surfaces of the aluminum roller are "hardcoat" anodized.

A still further specific object of the invention is to provide an outer shell of the developer roller which is non-conductive by reason of the fact that it may be made of an electrically nonconductive material such as plastic, molded fiberglass, glass and the like.

Yet another and more specific object of the invention is to provide an outer shell for the developer roller which is made of a moldable plastic material having sufficient thermosetting properties to resist deformation during operation of the copier machine.

Another object is to provide an outer shell for the developer roller which is made of a reinforced plastic material, preferably thermosetting, and reinforced with a polycarbonate resin, glass fibers or filaments, paper, wood, fabric or the like.

Another and still more specific object of the invention is to provide an outer shell for the developer roller which is made of a non-conductive material electrically, and which has thereon a coating or covering of a plastic material of the character which may be either applied to the surface of the shell by dipping or spraying, or by shrinking a plastic material onto the shell.

DETAILED DESCRIPTION OF THE INVENTION

Figures 1, 2, 3, 4, 5, 6:
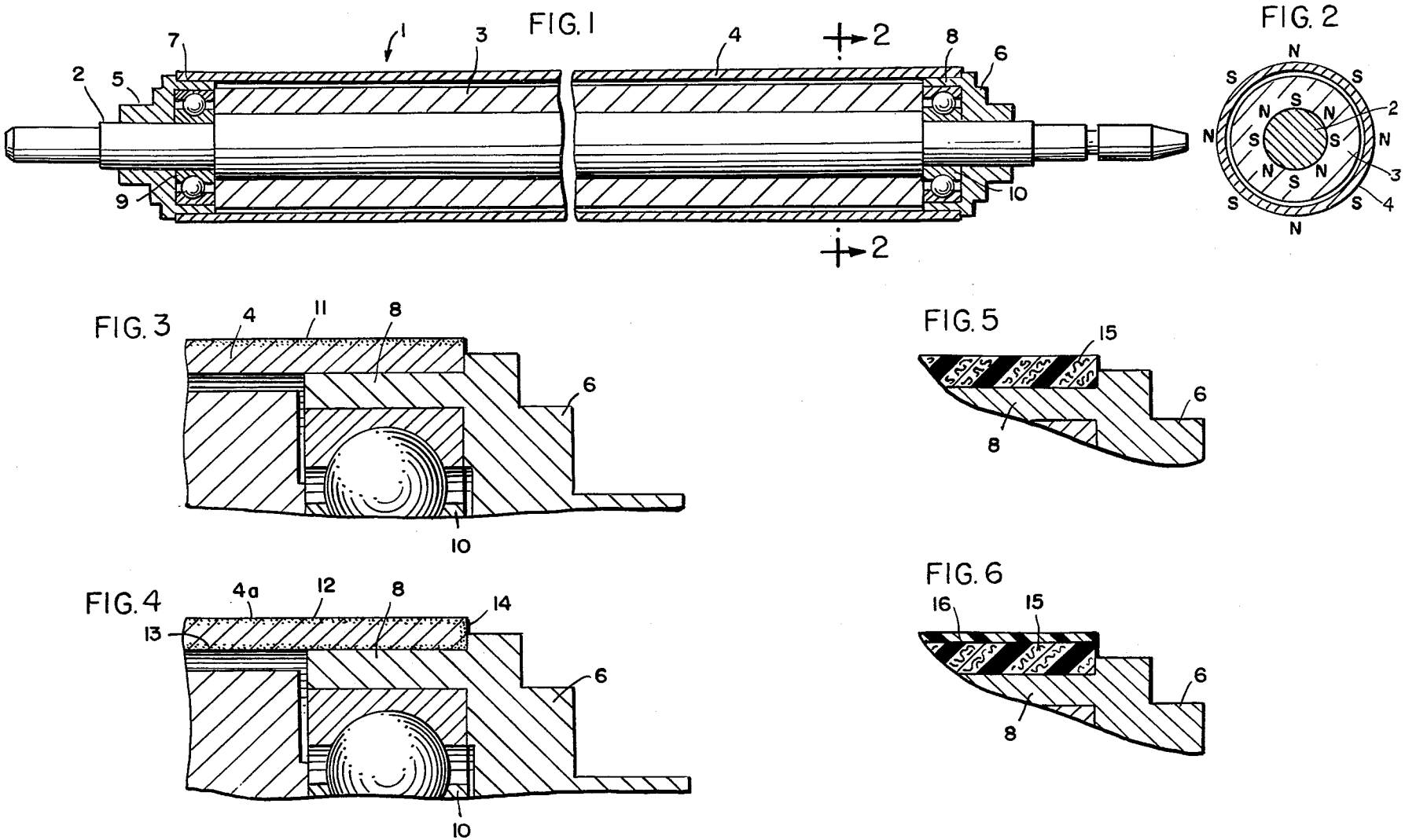
FIG. 1 is a longitudinal sectional view illustrating a developer roller embodying the present invention.
FIG. 2 is a vertical transverse sectional view of the roller of FIG. 1 taken substantially along the plane of line 2—2 of FIG. 1.
FIG. 3 is an enlarged fragmentary view partly in section of the upper right hand portion of FIG. 1 wherein the outer shell is shown with the outer surface hereof anodized to make it electrically non-conductive.
FIG. 4 is a view similar to FIG. 3, but illustrating all of the external surfaces of the outer shell as being anodized.
FIG. 5 is another enlarged fragmentary view similar to FIGS. 3 and 4 but illustrating the outer shell as being formed of a material which is electrically non-conductive.
FIG. 6. is a view similar to FIG. 5, but showing the non-conductive shell with an outer coating or covering of a plastic material which provides a smooth and relatively hard surface.

Referring now more particularly to the drawing and especially to FIG. 1 the developer roller in its entirety is indicated generally by the numeral 1. This roller is provided with a shaft each end of which is suitably formed so that it may be received in the mountings in the frame of the copy machine. The shaft 3 is caused to rotate by any well known means (not shown) during operation of the machine.

There is positioned around the shaft 2 a magnetic core 3. Although this magnetic core heretofore has consisted of a plurality of elongated sector-shaped members, it has been found to greatly improve the results if this magnetic core is a single solid piece but with sector-shaped sections thereof alternately magnetically polarized, as many be seen, for example, in FIG. 2.

A tubular outer shell 4 surrounds the magnetic core 3 in spaced relation thereto and, at each end thereof, it is supported by the end members 5 and 6. In the illustrated embodiment, each of the end members 6 is provided with an annular inwardly extending flange portion 7 and 8 which is received within the adjacent end of the shell 4.

In some instances it may be desirable to have the magnetic core remain stationary while the outer shell rotates, however, in the preferred embodiment disclosed herein the outer shell 4 remains stationary while the shaft 2 and magnetic core 3 rotate. Suitable bearing members 9 and 10 are provided at each end of the developer roller as shown in FIG. 1.

The outer shell, as mentioned heretofore, may be formed of a metal such as aluminum, and have at least the outer surface thereof "hardcoat" anodized as shown in FIG. 3. The outer anodized surface is illustrated by the numeral 11 in FIG. 3.

Anodizing is a process of conversion of aluminum to aluminum oxide by placing the shell in a suitable anodizing bath. Such coating not only penetrates into the surface but also is built up on the outer part of the surface and such anodized surface is electrically non-conductive.

The coating thickness of the anodized surface may vary, depending upon the particular aluminum alloy used, but a total thickness of a few thousandths of an inch will produce an extremely hard surface which is not attacked by the chemical composition of the toner and which renders the shell electrically non-conductive. A further advantage of the non-conductive shield resides in the fact that the toner particles may have less tendency to cling to the surface and it can be easily cleaned by wiping.

As a modified form of the invention it may be desirable to anodize all of the surfaces of the outer shell 4. This might facilitate the anodizing process, but the shell remains non-conductive whether the outer surface only is anodized, or all surfaces thereof as shown for example in FIG. 4. In this case the outer shell is indicated by the numeral 4*a*. The outer surface of the shell as anodized is indicated by the numeral 12, the inner anodized surface is shown at 13 and the ends of the shell are shown as being anodized at 14. Otherwise the shell operates in the same way to produce the same result at the shell shown in FIG. 3.

In some instances it may be desirable to have the entire body of the shell formed of an electrically non-conductive material, such as plastic, glass or a composition of glass fibers, and the like. Such a shell is indicated in FIG. 5 by the numeral 15 and this shell is likewise electrically non-conductive, although it does not attract the magnetic forces of the magnetic core 3, and equally affects the single component dry magnetic toner particles.

As the shaft 2 and magnetic core 3 rotate the magnetic attraction will pick up the single component magnetic toner particles from a source of such toner material such as a trough. In actual practice the copy sheet or other surface having latent electrostatic images thereon may pass in a plane below the developer roller adjacent thereto. The electrical charge on the image areas will attract the toner material thereto and thus develop the image areas thereon as the shaft and magnetic core rotate.

As mentioned above, the use of a non-conductive outer shell has been found to produce better copies. When the outer shell is formed of aluminum and is anodized on the surfaces thereof, not only does it create a hard outer surface, but also the chemicals used in the toner cannot attack the body of aluminum of which the shell is formed because the anodized surface protects it. Thus, the imperfections which could be caused normally without the anodized surface are not present on the surface which supports the toner material thereby improving the quality of the reproduction.

The same advantages are obtained when any other suitable non-conductive material is used such as described above. The surface of the shell remains relatively free of imperfections because the material is not attacked by chemicals in the toner.

It has been found that, depending upon the particular plastic material used, after a shell is formed such as by molding or extruding, the outer surface of the plastic material should be ground or polished to produce a highly polished or mirror surface. Also, if the surface is not sufficiently smooth a coating or covering of plastic material may be applied to the outer surface of the shell.

The plastic material of which the shell is formed must be smooth, heat resistant, have an ability to withstand high and low temperatures, be moisture repellent and moldable. It must also be sufficiently rigid so as to resist deformation during operation of the machine. For this reason a thermosetting plastic is preferable, although a thermoplastic material, reinforced with suitable fillers may also be used as long as the temperature is not too high.

FIG. 6 of the drawing illustrates a shell formed of an electrically non-conductive plastic material provided on the outer surface thereof with a coating or cover 16. One excellent covering for the shell has been found to be one which is known by the trademark Teflon. A sleeve of this material may be placed around the shell and shrunk thereon, thereby providing a hard and smooth surface ideally suited for use as a developer roller in this type of copy machine using a magnetic dry toner.

The shell may also be provided with a coating either by dipping the shell into a suitable plastic material or by spraying with a non-conductive material such as an epoxy.

It has also been found that a shell made from a paper base and impregnated with phenolic resin produces good results. Although the particular plastic used may be suitable by itself for forming such a shell, nevertheless such plastic materials are relatively expensive and it is much more economical to reinforce the plastic material with a suitable filler such as glass fibers or filaments, paper, wood, fabric or the like. The shell is first molded or extruded then centerless ground and coated as above described, and such a shell is electrically non-conductive and has all of the other characteristics necessary, as above outlined, for producing good copies as well as a great number of good copies without having the toner adhere to the surface and without being attacked chemically and becoming rough.

Changes may be made in the form, construction and arrangement of parts from those disclosed herein without in any way departing from the spirit of the invention or sacrificing any of the attendant advantages thereof, provided, however, that such changes fall within the scope of the claims appended hereto.

We claim:

1. In an electrostatic photocopy machine, wherein a single component magnetic toner material is collected on the surface of a developer roller from a source of said material and transferred to electrically charged image areas on the surface of a copy sheet moving in a plane adjacent thereto, an improved developer roller construction which comprises a shaft mounted for rotation, an axially extending magnetic core surrounding said shaft and divided into axially extending segments, wherein adjacent segments have opposite polarity, and producing a uniform magnetic field, and an outer shell surrounding said magnetic core in spacial relation thereto, said shell and core being rotatable relative to each other thereby to collect uniformly the single component toner material on the surface of said shell during rotation of one of said shell or core, said shell being electrically non-conductive, thereby to resist attack by chemicals in said toner which tend to create imperfections in the surface of said shell which cause poor reproduction of copies.

2. The combination of elements defined in claim 1, wherein said shell is aluminum, and is made electrically non-conductive by anodizing and creating a hard surface of aluminum oxide on the outer surface thereof on which said toner material is collected.

3. The combination of elements defined in claim 1, wherein said shell is aluminum, and is made electrically non-conductive by anodizing and creating a hard surface of aluminum oxide on all external surfaces thereof.

4. The combination of elements defined in claim 1, wherein the entire body of said electrically non-conductive shell is formed of an electrically non-conductive material.

5. The combination of elements defined in claim 1, wherein said electrically non-conductive shell is formed of a moldable plastic material having sufficient thermosetting properties to resist deformation during operation of the machine.

6. The combination of elements defined in claim 1, wherein said electrically non-conductive shell is formed of a plastic material and has an outer covering thereon of an electrically nonconductive plastic material.

7. The combination of elements defined in claim 4, wherein said shell also includes an outer covering of an electrically nonconductive plastic material.

8. The combination of elements defined in claim 4, wherein said shell also includes an outer covering of heat shrinkable plastic material shrunk onto the outer surface thereof.

9. The combination of elements defined in claim 5, wherein said shell also includes an outer covering of an electrically non-conductive plastic material.

10. The combination of elements defined in claim 5, wherein said shell also includes an outer covering of a heat shrinkable plastic material shrunk onto the outer surface thereof.

* * * * *